US005181866A

United States Patent [19]

Jerome et al.

[11] Patent Number: 5,181,866

[45] Date of Patent: Jan. 26, 1993

[54] HIGH RETENTION LOW INSERTION FORCE ELECTRIC FEMALE DISCONNECT

[75] Inventors: Michael E. Jerome, Toms River; Thomas A. Jerome, Barnegat, both of N.J.

[73] Assignee: Heyco Stamped Products, Inc., Toms River, N.J.

[21] Appl. No.: 679,616

[22] Filed: Apr. 3, 1991

[51] Int. Cl.[5] ..... H01R 13/00

[52] U.S. Cl. ..... 439/850

[58] Field of Search ..... 439/845, 849, 850

[56] References Cited

U.S. PATENT DOCUMENTS

| | | | |
|---|---|---|---|
| 2,774,951 | 12/1956 | Kinkaid et al. | 339/258 |
| 2,921,287 | 1/1960 | Matthysee et al. | 339/258 |
| 2,966,026 | 8/1961 | Batcheller | 439/850 |
| 3,139,319 | 6/1964 | Binder et al. | 339/258 |
| 3,409,867 | 11/1968 | Lessner | 339/258 |
| 3,550,069 | 12/1970 | Teagno | 339/256 |
| 4,685,754 | 8/1987 | Coldren | 439/270 |
| 4,691,981 | 9/1987 | Coldren | 439/816 |
| 4,764,133 | 8/1988 | Kaneko | 439/889 |
| 4,781,628 | 11/1988 | Detter et al. | 439/850 |
| 4,810,215 | 3/1989 | Kaneko | 439/845 |

FOREIGN PATENT DOCUMENTS

| | | | |
|---|---|---|---|
| 1615002 | 5/1970 | Fed. Rep. of Germany | 439/849 |
| 2517069 | 10/1976 | Fed. Rep. of Germany . | |
| 1312116 | 11/1962 | France | 439/849 |
| 1567727 | 5/1969 | France | 439/849 |
| 626449 | 10/1961 | Italy . | |
| 720592 | 3/1980 | U.S.S.R. | 439/849 |
| 858115 | 1/1961 | United Kingdom | 439/849 |

*Primary Examiner*—Joseph H. McGlynn
*Attorney, Agent, or Firm*—Auslander & Thomas

[57] ABSTRACT

A high retention, yet relatively low insertion force and withdrawal force female disconnect receptacle is provided. The female disconnect has a pad rising from its base, preferably lanced from the base. The lancing provides a firmness to the pad interacting with the metal of the base which holds a metal tab well, with a desired low insertion force and low withdrawal force that retains and does not easily degrade upon reuse. The pad preferably has a flat bearing surface.

21 Claims, 2 Drawing Sheets

FIG. 1
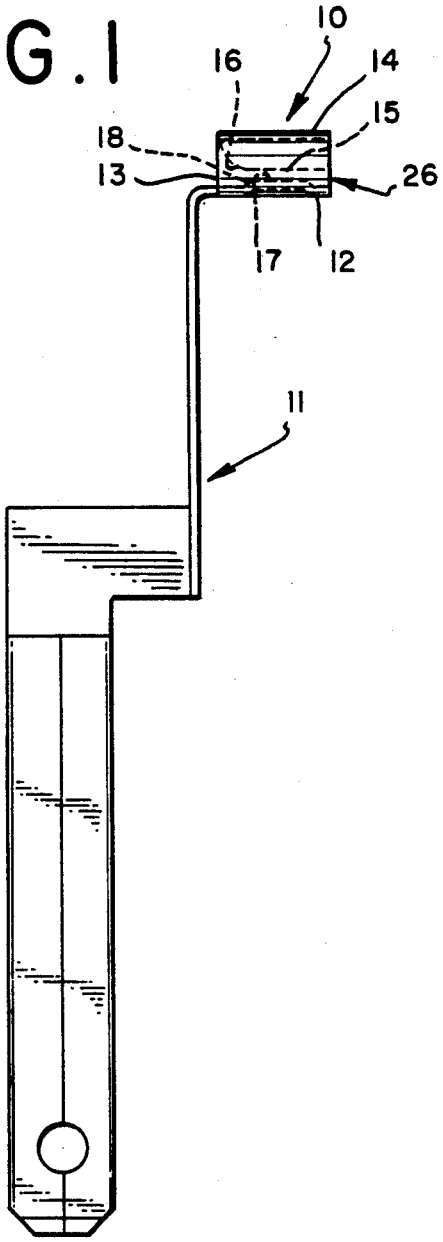
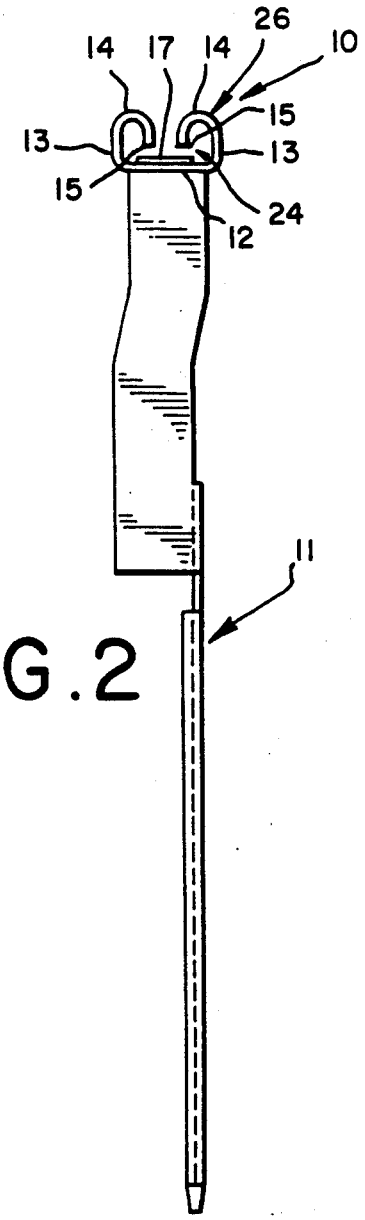
FIG. 2
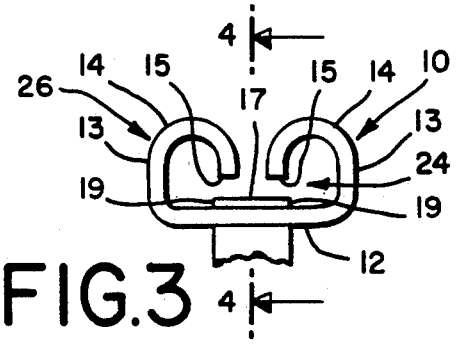
FIG. 3
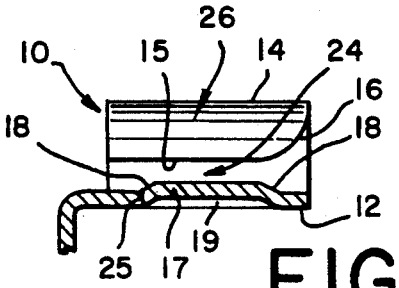
FIG. 4

FIG. 5
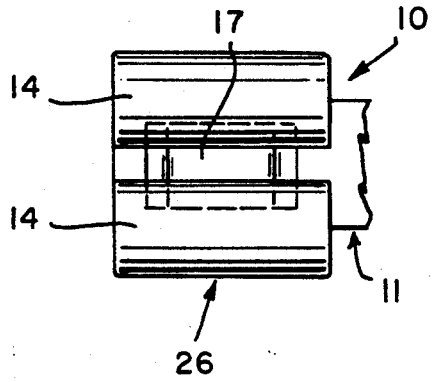
FIG. 6
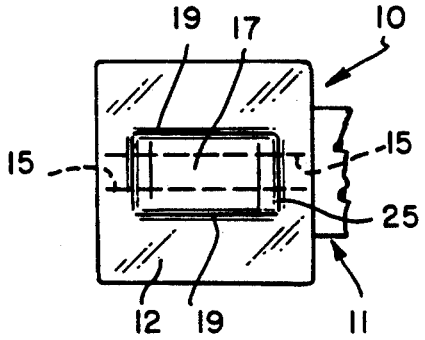
PRIOR ART
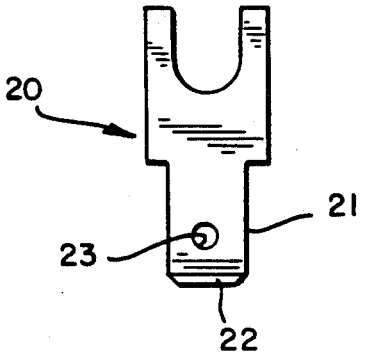
FIG. 7
PRIOR ART
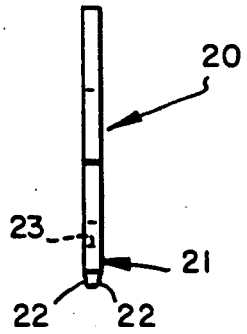
FIG. 8

HIGH RETENTION LOW INSERTION FORCE ELECTRIC FEMALE DISCONNECT

BACKGROUND OF THE INVENTION

The present invention is a low insertion and withdrawal force metal stamped female receptacle electrical part.

In the electrical industry, it is necessary to provide parts that function with integrity and sustain their performance with integrity. There are industry standards to define performance. Standards are often set so that they can be certified.

Performance also can be tested and certified by outside organizations such as Underwriters Laboratories. Such standards organizations enable the customer and the public to be able to rely on standard compliance, the purveyor to know that standards are met and that customers can be assured of the integrity of the parts bought to comply with their needs.

Female receptacles for receiving tabs ideally should receive a tab with a low insertion force. The tab should be held with integrity and yet be easily removable. The tab ideally may be removed and reinserted. In such removal and reinsertion there must be integrity. The reinserted tab ideally should have a low insertion force and yet still be held with integrity. A problem with regard to female tab receptacles is that even though insertion and withdrawal of tabs may be satisfactory, reinsertion and withdrawal may cause a degradation of holding integrity.

The prior art interactive detents and declivities may have been effective for holding the tabs and females. They posed the double problem of high insertion and withdrawal force and the problem of rapid wear, reducing the ability of the parts to hold satisfactorily after multiple withdrawals and insertions.

The structure of the various tab receiving female receptacles and tabs of the prior art was complex to manufacture, requiring multiple steps for stamping, cutting out and bending of complex shapes.

The problem is also complex, since in electrical and electronic hardware, many suppliers may supply similar components which must be joined to different suppliers parts, yet integrity must be maintained in the assembled hardware.

A high withdrawal force in the female disconnect is desirable for retention purposes. Large surface contact is desirable for acheiving this.

The present invention fills a need, improving a well known receiving female receptacle such as described above.

DESCRIPTION OF THE RELATED ART

The prior art discloses many different variations of tab receiving female receptacle which must adapt to many variations of tabs.

A typical tab receiving female receptacle has a generally channel section body having a base and opposite sidewalls which have free ends rolled over to provided stiffly resilient arms which overlie the base.

The tab receiving female receptacle must be responsive to a variety of tabs. The tabs may be folded, or solid, have flexible spring like leaves, have declivities, tracks, rails, spring like tongues or have openings to reengage special portions of the tab receiving female receptacle.

Tab receiving female receptacles have assorted structure to engage tabs. There are curvatures, curved bases, tracks, rails, dimples, pimples, tongues and elevated portions in the base.

U.S. Pat. No. 3,550,069 discloses tab receiving female receptacle having L shaped cantilevered spring like tracks 2, 5 cut out and extending upward from the base and a central elevated portion, spaced apart from the tracks 2, 5, centered in the opening formed by the formation of the springs. The central portion 6 is also provided with a dimple 7. The tab is held between the flat folded side portions 10 and the cantilevered springs 2, 5. There are no free ends rolled over for grasping.

U.S. Pat. No. 3,409,867 discloses tab receiving female receptacle having rolled over sides and a resilient tongue with a drop off end forming a detent for a quick disconnect connector. The tongue interacts with a declivity in the tab.

U.S. Pat. No. 4,691,981 discloses a tab receiving female receptacle with a slightly arched base and rolled over sides. The tab receiving female receptacle receives a folded somewhat spring like tab with an opening that interacts with a pimple 16. U.S. Pat. No. 2,774,951 is a tab receiving female receptacle similar to U.S. Pat. No. 4,691,981, it includes ridges to interact with a detent. U.S. Pat. No. 3,139,318 is another tab receiving female receptacle similar to U.S. Pat. No. 4,691,981, it including a stamped out depression or impression in the base of the receptacle to interact with a tab. U.S. Pat. No. 2,921,287 differs from the prior patents in that it has a double roll over arm configuration aligned on either side.

Soviet Patent No. 720,592 provides a detent extending from the rolled over walls of the tab receiving female receptacle.

Italian Patent No. 626,449 is a flat sided tab receiving female receptacle with a folded over spring like dimpled base.

U.S. Pat. No. 4,685,754 discloses a complex tab receiving female receptacle having upstanding sidewalls, and a detent and detent release to release a tab.

U.S. Pat. No. 4,746,133 is exemplary of specialized tabs for tab receiving female receptacles.

U.S. Pat. No. 4,810,215 and German Offenlegungsschrift No. 25 17 069 are exemplary of the variety of female receptacles.

SUMMARY OF THE INVENTION

The present invention is a low insertion force and withdrawal force tab receiving female receptacle. The tab receiving female receptacle firmly engages conventional tabs holds them. They are engagable with a low insertion force, securely held with a high retention force for retention purposes. Tabs are not difficult to withdraw. Repeated insertion and withdrawal can be done with only minor degradation of the insertion and withdrawal force and the maintaining of acceptable parameters.

The tab receiving female receptacle of the present invention achieves its holding and low insertion and withdrawal force with a variety of tabs. Tabs with or without detent receiving openings are accepted. Prior art detents, tongues, curved bases are not needed. The problem of wearing down the detents and various catches after repeated use is substantially overcome by the structure of the present invention. The female receptacle may function as a separate metal part or as integral part of a more complex electrical fitting.

The tab receiving female receptacle, whether integral to another part or as a stand alone fitting, is the only and single formed piece of metal. The inwardly impressed pad in the base is a simple structure doing the work of prior art structures in a simpler, better way. The impression provides a relatively large bearing surface for engaging a tab and easily, yet firmly, holding the tab against the longitudinal rolled wall edges of the arms in firm engagement. There are no small detents to wear out or to unnecessarily raise the insertion or withdrawal force of the tab.

In the present invention, the pad is slightly cambered, gently rising to its level. The camber guides the tab into position smoothly with a minimum of abrasive wear. The tabs are usually tapered or cambered, further facilitating the insertion process. Any curvature in the pad would reduce the bearing surface and expose a smaller surface to ultimate wear.

The normal resilience of the arms establishes a flexure for tab tolerances and variations, so that different tabs with various different parameters can be accepted by the tab receiving female receptacle in the present invention, without substantial change of the low insertion force or withdrawal force required and with little degradation on reuse.

In a preferred embodiment, a flat pad is lanced on three sides and has a substantially large flat bearing surface. The receiving end of the body channel is ramped with a camber or taper opposite a single end lance. The female disconnect of the present invention has high surface contact with the male tab, good retention, can carry a high current load, does not arc and can be used in high vibration applications.

According to the present invention a high retention, low insertion and withdrawal force electrical female disconnect stamped metal receptacle for engagement of a conductive metal tab is provided. It has a generally channel section body including a base and opposite sidewalls. The opposite sidewalls are rolled over and form edges of stiffly resilient arms. The arms overly the base. There is a pad in the body inward of the level of the base. The edges of the arm are on a plane spaced a distance from the pad slightly less than the thickness of the insertion portion of a male tab. The pad has a substantially flat upper surface.

The pad may be spaced inward from the sidewalls and also inward from the ends of the channel section of the body. The pad may be substantially rectangular and also centered in the base. The pad may be impressed inward from the base. The ends of the pad adjacent the ends of the channel section of the body may be cambered.

The sides of the pad adjacent the sidewalls may be lanced from the base. One end of the pad may also be lanced, particularly from the end of the pad opposite the normal entry portion of the channel section.

Two, or all of the adjacent ends of the arms may be cambered inward to the edges. The cambered ends of the arms may be at the normal entry portion of the channel section of the body.

The female disconnect of the present invention may be integral to a metal electrical part.

The sides of the impressed pad adjacent the sidewalls may be lanced from the base and the and the ends of the pad adjacent the ends of the channel section of the body may be cambered and one end of the pad may be lanced from the base. The lanced end of the pad may be opposite the normal entry portion of the channel section and the the end of the pad opposite the lanced end of the pad may be cambered.

Where at least two of the adjacent ends of the arms are cambered to the edges and the pad is impressed inward from the base, the sides of the pad adjacent the sidewalls may be lanced from the base, the ends of the pad adjacent the ends of the channel section of the body may be cambered. One end of the pad may be lanced from the base, the lanced end of pad may be opposite the normal entry portion of the channel section and the end of the pad opposite the lanced end of the pad may be cambered.

Although such novel feature or features believed to be characteristic of the invention are pointed out in the claims, the invention and the manner in which it may be carried out may be further understood by reference to the description following and the accompanying drawing.

BRIEF DESCRIPTION OF THE DRAWING

FIG. 1 is a side elevation of the tab receiving female receptacle of the present invention integral to an electrical fitting.

FIG. 2 is a rear elevation of FIG. 1.

FIG. 3 is a detail rear elevation of tab receiving female receptacle as shown in FIGS. 1 and 2.

FIG. 4 is a side section of FIG. 3 at lines 4—4.

FIG. 5 is a left hand plan view detail of tab receiving female receptacle as shown in FIG. 1.

FIG. 6 is a right hand bottom plan view detail of tab receiving female receptacle as shown in FIG. 3.

FIG. 7 is a top plan view of a tab of the prior art.

FIG. 8 is a side elevation of FIG. 7.

Referring now to the figures in greater detail, where like reference numbers denote like parts in the various figures.

DESCRIPTION OF THE PREFERRED EMBODIMENTS

The female disconnect receptacle 10 of the present invention, as shown in FIGS. 1 and 2 is integrally connected to a male electrical part 11. The female disconnect 10, as shown in detail in FIGS. 1 through 6, has a base 12, substantially right angulated extending sidewalls 13, the base 12 forming a channel 24. The sidewalls 13 are rolled over, having a rounded top 14 and end at edges 15. The sidewalls 13 with their rounded tops 14 and edges 15 substantially form stiffly resilient arms 26 overlying the base 12.

Between the rounded top 14 and the edge 15, there is a camber 16 at least at the portion of the female disconnect receptacle into which the insertion portion 21 of the tab 20, as shown in FIGS. 7 and 8, is engaged with the female disconnect receptacle 10.

There is a pad 17, as can be seen in FIG. 4, which has lance 19 and lance 25. These lances 19, 25 physically separate the pad 17 at the lancing from the material of the base 12. The pad 17 has cambers 18 at either end in the channel formed in the female disconnect receptacle 10.

As shown in FIGS. 7 and 8, a prior art male tab 20 with its insertion portion 21, is also provided with a cambers 22 at its insertion portion 21. The cambers 22 may also be in the form of a short taper. The insertion portion 21 usually includes an opening 23, which is used for engagement with detents found in prior art female disconnect receptacles.

The pad 17 has lances 19 and 25 and the pad is impressed into the channel 24 portion of the female disconnect 10, and slightly elevated from the base 12.

The end portion of the pad 17 may have a lance 25, preferably away from the direction that the insertion portion 21 of the tab 20 is engaged in the channel 24 of the female disconnect receptacle 10.

The impressing of the pad 17 also forms cambers 18. There is a camber 16 on the arms 26 at the entry point for the insertion portion 21 of the tab 20. The cambers 18 and cambers 16 act as guides to interact with the cambers 22 on the insertion portion 21 of the tab 20, to act as interactive bearing surfaces to facilitate the engagement of the insertion portion 21.

The metal of the pad 17 is physically separated from the base 12, but in such small measure that the metal itself is physically engaged with the base 12 and cannot easily move, although greater flexure is enabled by the lances 19 and 25, separating the pad 17 on three sides. No light can be seen passing between the pad 17 and the lances 19, 25.

The female disconnect 10 may satisfactorily function and flex without the lance 25 separating one end of the pad 17 from the base 12.

The flexure of the pad 17 reduces the insertion force necessary to engage the insertion portion 21 of the tab 20 and further reduces the withdrawal force necessary for the withdrawal of the insertion portion 21 of the tab 20.

The flat upper portion of the pad 17 smoothly engages the insertion portion 21 of the tab 20, held tightly by the springy resilience of the arms 26, which engage the upper surface of the insertion portion 21.

The female disconnect receptacle 10 with the tab's 20 insertion portion 21, inserted, has a high current carrying capacity because of the large surface contact and reduces or eliminates the possibility of arcing between the parts. The female disconnect receptacle 10 may be used in high vibration applications.

The pad 17 has greater resilience because of the lance 19, 25, even though it cannot freely move against the separated metal of the base 12. Thus, the construction of the female disconnect 10 of the present invention tends to reduce the initial withdrawal force of the tab 20, generally to below that of the prior art. The insertion and withdrawal forces, of course, vary with the individual differences of the parts, such as whether or not they are washed, dried, solvent cleaned, tinned, etc. Particularly where prior art detents are involved in the holding or inserting of the insertion portions 21 in prior art female disconnect receptacles, the insertion and withdrawal require more force.

The resilience of the pad 17 with its specific construction, further reduces the degradation and wear on the female disconnect receptacle 10 and the tab 20 and insertion portion 21, so that upon subsequent withdrawals, the pound force for withdrawing the tab 20, only reduces slightly.

Thus, the integrity of the parts and the integrity of the electrical current carrying capacity of the connected female disconnect receptacle 10 and tab 20 with its insertion portion 21, are maintained.

Industrial standards substantially dictate the parameters and the sizes of the female disconnects 10 and insertion portions 21 and testing procedures. Thus, there are various tests prescribed by industrial standards, such as NEMA DC 2-1982(R1988) Residential Controls-Quick Connect Terminals and Underwriters Laboratories Standards for Safety ANSI/UL 310-1986. Thus, the actual dimensional relationships between the parts are substantially prescribed and well known in the art. The physical relationships of the mated parts determine the effectiveness of the present invention.

EXAMPLE 1

Female disconnects 10 and tabs 20 with their insertion portions 21, were tested for insertion and withdrawal in accordance with ANSI/UL Specification 310.

This specification calls for a maximum initial insertion force of fifteen pounds, a maximum initial withdrawal force of twenty pounds, to be met in conjunction with a minimum average of five pounds of withdrawal force and an individual minimum withdrawal force of three pounds. With six withdrawals, the withdrawal force should have a minimum average of three pounds and an individual minimum of no less than two pounds for any particular withdrawal. Three normal production tabs, spun dry, were tested with the results as follow:

| Sample No. | Initial Insertion | Initial Withdrawal | Sixth Withdrawal |
|---|---|---|---|
| 1 | 12.5 | 9.5 | 8.5 |
| 2 | 12.0 | 10.25 | 9.25 |
| 3 | 12.5 | 9.5 | 8.5 |

The female disconnect 10 for the test included lances 19, but did not include lance 25.

EXAMPLE 2

Female disconnects 10 and tabs 20 with their insertion portions 21, were tested for insertion and withdrawal in accordance with ANSI/UL Specification 310, as above in Example 1.

Samples conforming to UL 310 Specifications were tested on female disconnects 10 of the present invention which included lances 19 only.

The disconnects had been cleaned with trichloroethane solution. The male test tab was not plated and was not immersed in the solution, but was wiped clean with a dry towel.

The first insertion produced an average of 5.82 pounds of insertion force with a range from three and one half pounds to nine and one half pounds.

The initial withdrawal was an average 7.68 pounds, ranging from withdrawal force of five and one half pounds to nine and one half pounds. The female disconnect receptacle had an outside diameter of 0.250 and the insertion portion had a width of 0.187.

The sixth withdrawal came to an average of 8.79 pounds, ranging from six and one half pounds to eleven and one half pounds.

The test tab had a thickness tolerance of $0.032 \pm 0.001$.

EXAMPLE 3

Female disconnects, including lances 19 and 25, were tested under Underwriter Laboratories Parameters 310 with tabs of thickness of $0.032 \pm 0.0003$. The sample tabs were not washed, not blown clean and left overnight.

| Sample # | 1st Insertion | 1st Withdrawal | 6th Withdrawal |
|---|---|---|---|
| 1 | 7 lbs. | 9¾ lbs. | 7 lbs. |
| 2 | 4¾ lbs. | 8 lbs. | 7½ lbs. |
| 3 | 6 lbs. | 9½ lbs. | 7½ lbs. |
| 4 | 5½ lbs. | 7¾ lbs. | 7½ lbs. |
| 5 | 5½ lbs. | 8¾ lbs. | 7½ lbs. |
| 6 | 6 lbs. | 8 lbs. | 6½ lbs. |
| 7 | 6½ lbs. | 8½ lbs. | 6½ lbs. |
| 8 | 6 lbs. | 8¼ lbs. | 6¾ lbs. |
| 9 | 4¾ lbs. | 7¾ lbs. | 6¾ lbs. |
| 10 | 6¾ lbs. | 9½ lbs. | 8¾ lbs. |
| AVG. | 5.875 lbs. | 8.575 lbs. | 7.2 lbs. |

EXAMPLE 4

Female disconnects, including lances 19 and 25, were tested under Underwriter Laboratories Parameters 310 with tabs of thickness of 0.032±0.0003. The samples were not washed, not blown clean and left overnight.

| Sample # | 1st Insertion | 1st Withdrawal | 6th Withdrawal |
|---|---|---|---|
| 1 | 5¾ lbs. | 8¾ lbs. | 7½ lbs. |
| 2 | 6¾ lbs. | 8¾ lbs. | 7¼ lbs. |
| 3 | 7½ lbs. | 8½ lbs. | 7½ lbs. |
| 4 | 5¼ lbs. | 9¼ lbs. | 7¾ lbs. |
| 5 | 5¾ lbs. | 8½ lbs. | 7¼ lbs. |
| 6 | 5¼ lbs. | 8½ lbs. | 8¼ lbs. |
| 7 | 5½ lbs. | 8 lbs. | 8½ lbs. |
| 8 | 8 lbs. | 10½ lbs. | 7¼ lbs. |
| 9 | 4½ lbs. | 7¾ lb. | 6½ lbs. |
| 10 | 6 lbs. | 8½ lbs. | 7¼ lbs. |
| AVG. | 6.025 | 8.70 | 7.50 |

EXAMPLE 5

Female disconnects, including lances 19 and 25, were tested under Underwriter Laboratories Parameters 310 with tabs of thickness of 0.032±0.0003. The samples were warm water washed and blown clean.

| Sample # | 1st Insertion | 1st Withdrawal | 6th Withdrawal |
|---|---|---|---|
| 1 | 6½ lbs. | 9 lbs. | 10 lbs. |
| 2 | 5¼ lb. | 7½ lbs. | 6 lbs. |
| 3 | 4¾ lbs. | 7 lbs. | 8 lbs. |
| 4 | 5½ lbs. | 7½ lbs. | 11¼ lbs. |
| 5 | 6¼ lbs. | 9 lbs. | 8¾ lbs. |
| 6 | 5 lbs. | 8¾ lbs. | 10½ lbs. |
| 7 | 7½ lbs. | 11 lbs. | 10½ lbs. |
| 8 | 6 lbs. | 8½ lb. | 11¼ lbs. |
| 9 | 6 lbs. | 8½ lbs. | 9¼ lbs. |
| 10 | 5¾ lbs. | 9 lbs. | 8¼ lbs. |
| AVG. | 5.850 | 8.525 | 9.35 |

A typical preferred embodiment of the female disconnect receptacle 10 of the present invention, in one size, has an outside diameter of 0.250 thousands of an inch, an inside diameter between the sidewalls 13 of 0.206 thousands of an inch. The wall edges 15 are typically spaced 0.025 thousands of an inch, from the upper portion of the pad 17. The pad 17 is impressed into the base 12 a distance of 0.010. The edges 15 of the arms 26 are preferably centered over the pad 17, spaced apart 0.050. The pad 17 is centered in the channel 24 and is 0.100 wide. The general tab thickness is generally 0.032 thousands of an inch. Thus, the female disconnect receptacle 10, with the insertion portion 21, must generally have to flex for about 0.007 to accommodate the insertion portion 21. The standards set the usual tolerance parameters.

Both ends of the arms 26 may include an edge camber 16. Of course, insertion may be made without the camber 16, although inserting at the camber 16 in the channel 24 opening is preferable.

Where insertion of the tab portion 21 is made from either end of the channel 24 it is preferable that there be no lance 25, which might project an impediment at an end of the pad 17.

Although the lances 19, 25 separate the metal of the pad 17 from the metal of the base 12, the metal is so closely engaged that no light can pass through and there is no freedom of movement of the separated sections between the metal parts.

The terms and expression which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A high retention low insertion and withdrawal force electrical female disconnect stamped metal receptacle for engagement of a conductive metal tab comprising a generally channel section body, said body including a base, said base including opposite sidewalls, said base further including a floor, said opposite sidewalls rolled over, said rolled over sidewalls having edges, said edges of said rolled over sidewalls on a plane, said rolled over sidewalls and said edges forming stiffly resilient arms, said arms adjacent each other and overlying said floor, said floor having ends, said floor having a pad, said pad impressed inward of the level of said floor, said pad having a flat upper surface, said pad having side edges, said side edges adjacent said sidewalls, said side edges lanced from said floor, said pad having ends, said pad ends adjacent said floor ends, said pad including a slight spring resilience with regard to said floor, said tab including an insertion portion, said sidewall edges engagable with said tab insertion portion along their length, said edges spaced a distance from said pad slightly less than the thickness of said insertion portion of said tab, said arms with their edges being engagable to spring bias said insertion portion of said tab toward said pad, and said flat upper surface of said pad fully engagable with said insertion portion of said tab.

2. The invention of claim 1 wherein said pad is spaced inward from said sidewalls.

3. The invention of claim 1 wherein said pad is substantially rectangular.

4. The invention of claim 1 wherein said pad is centered in said base.

5. The invention of claim 1 wherein the ends of said pad adjacent the ends of said channel section of said body are cambered.

6. The invention of claim 1 in combination with a integral metal electrical part.

7. The invention of claim 1 wherein the ends of said pad adjacent the ends of said channel section of said body are cambered.

8. The invention of claim 1 wherein said pad is spaced on said base inward from the ends of said channel section of said body.

9. The invention of claim 8 wherein said pad is spaced inward from said side walls.

10. The invention of claim 1 wherein one end of said pad is lanced from said base.

11. The invention of claim 10 wherein said lanced end of said pad is opposite the normal entry portion of said channel section.

12. The invention of claim 1 wherein two of the adjacent ends of said arms are cambered inward to the edges.

13. The invention of claim 12 wherein said cambered ends of said arms are at the normal entry portion of said channel section of said body.

14. The invention of claim 1 wherein at least two of the adjacent ends of said arms are cambered inward to the edges.

15. The invention of claim 14 wherein the ends of said pad adjacent the ends of said channel section of said body are cambered.

16. The invention of claim 14 wherein one end of said pad is lanced from said base.

17. The invention of claim 16 wherein said lanced end of said pad is opposite the normal entry portion of said channel section.

18. The invention of claim 17 wherein the end of said pad opposite the lanced end of said pad is cambered.

19. The invention of claim 1 wherein one end of said pad is lanced from said base.

20. The invention of claim 19 wherein said lanced end of said pad is opposite the normal entry portion of said channel section.

21. The invention of claim 20 wherein the end of said pad opposite the lanced end of said pad is cambered.

* * * * *

UNITED STATES PATENT AND TRADEMARK OFFICE

CERTIFICATE OF CORRECTION

PATENT NO. : 5,181,866

DATED : January 26, 1993

INVENTOR(S) : Michael E. Jerome, et al

It is certified that error appears in the above-indentified patent and that said Letters Patent is hereby corrected as shown below:

Column 8, claim 4, line 2, insert and change "base" to --floor--
claim 6, line 1, insert and change "a" to --an--
claim 7, lines 2 and 3, delete "channel section of said body" and insert --floor--

Column 9, claim 8, line 2, insert and change "base" to --floor--
lines 2 and 3, delete "channel section of said body" and insert--floor--
claim 10, line 2, insert and change "base" to --floor--
claim 11, line 2, after "normal" insert --tab--
claim 13, line 2, after "normal" insert --tab--

Column 10, claim 17, line 2, after "normal" insert --tab--
claim 20, line 2, after "normal" insert --tab--

Signed and Sealed this

Twenty-ninth Day of March, 1994

*Attest:*

Bruce Lehman

BRUCE LEHMAN

*Attesting Officer*

*Commissioner of Patents and Trademarks*